US006415948B1

(12) United States Patent
Granger

(10) Patent No.: US 6,415,948 B1
(45) Date of Patent: Jul. 9, 2002

(54) DEVICE FOR CONTROLLING AND LIMITING THE DRUM ROTATION IN A WIPING MATERIAL DISPENSER

(76) Inventor: Maurice Granger, 17 Rue Marcel Pagnol, F42270 Saint Priest en Jarez (FR)

( * ) Notice: Subject to any disclaimer, the term of this patent is extended or adjusted under 35 U.S.C. 154(b) by 0 days.

(21) Appl. No.: 09/674,610

(22) PCT Filed: May 18, 1999

(86) PCT No.: PCT/FR99/01175

§ 371 (c)(1),
(2), (4) Date: Nov. 3, 2000

(87) PCT Pub. No.: WO99/66822

PCT Pub. Date: Dec. 29, 1999

(30) Foreign Application Priority Data

Jun. 19, 1998 (FR) ..... 98 07967

(51) Int. Cl.[7] ..... G07F 11/72
(52) U.S. Cl. ..... 221/30; 83/649
(58) Field of Search ..... 221/33, 1, 30, 221/45, 227; 83/334, 335, 649, 949, 298

(56) References Cited

U.S. PATENT DOCUMENTS 3,896,691 A * 7/1975 Granger et al. ..... 83/335

FOREIGN PATENT DOCUMENTS

| | | |
|---|---|---|
| FR | 2621303 | 4/1989 |
| GB | 2164920 | 4/1986 |
| WO | 97 24970 | 7/1997 |
| WO | 97 36528 | 10/1997 |

* cited by examiner

*Primary Examiner*—Kenneth W. Noland
(74) *Attorney, Agent, or Firm*—Wall Marjama & Bilinski LLP

(57) ABSTRACT

The invention concerns a device for controlling and limiting the drum rotation in a wiping material dispenser comprising a housing (1), a cover (3), the housing having flanges (2) supporting a reel stand (4), a drum (5) with a cutting device (6), the drum including at one of its ends an eccentric element (7) associated with a release and return spring (8) the other end being associated with a control flywheel (9). The invention is characterized in that it is formed by a single component (10) arranged and shaped like an irregular crown to ensure various functions controlling and limiting the drum (5) rotation when a strip of material is cut, said component being in the form of a planar part and having an external profile combining curvilinear and rectilinear irregular successive shapes with projecting zones, and said component is fixed on one of the drum lateral flanges in free and floating assembly, and capable of moving according to the drum rotating conditions, in normal or accelerated rotation for controlling and stopping the drum.

11 Claims, 8 Drawing Sheets

DEVICE FOR CONTROLLING AND LIMITING THE DRUM ROTATION IN A WIPING MATERIAL DISPENSER

FIELD OF THE INVENTION

The invention relates to the technical field of dispensing machines for tissue-paper or similar type wipe materials intended for wiping the hands or toilet paper, the strip of material being folded or not folded.

BACKGROUND OF THE INVENTION

The Applicant has developed numerous automatic and semi-automatic versions of dispensing machines of this type.

The dispensing machines are of the type comprising a housing (1) capable of accommodating a swivel cover (3). The housing accommodates end shields (2) that support a reel holder (4) of wipe material in its upper part. In the lower part, a drum (5) is rotatably mounted with said end shields and is devised to accommodate the cutting device (6). The drum may be designed so that one of its ends has a cam (7) associated with a start and return spring (8), one end **(8*a*) of which is attached to a finger (7*a*) associated with the cam and the other end (8*b*) of which is associated with a fixed part of one of the lateral end shields (2) of the housing. The other end of the drum is associated with an operating knob (9)** which is used to load the dispensing machine.

The reel of material rests against the periphery of the drum. The user may pull the strip of material by exerting more or less force and, if there is no means of blocking, this may cause inadvertent unreeling of several strips of material.

In order to meet this need, the Applicant has developed a mechanism for setting the machine which includes a shock absorbing device and pawl, spring and shaft, small weight, shaft and fixing unit that are defined, in particular, in French Patent 87 14068. The number of components involved is therefore relatively large with correspondingly high costs for the moulds needed for the shock absorbing device, small weight and pawl shapes. In addition, assembly takes a relatively long time and is not always straightforward for persons who are not familiar with the job.

The Applicant has therefore worked toward simplifying the mechanism for controlling and limiting the rotation of the drum by reducing the number of parts and components needed in order to fulfil the above-mentioned functions.

SUMMARY OF THE INVENTION

One object sought after by the Applicant was to ensure easier assembly of the device by replacing the parts and components according to the prior art.

These objects and others will become apparent from the following description.

According to a first aspect of the invention, the device for controlling and limiting the rotation of the drum in a dispensing machine for material wipes of the type comprising a housing and a cover, the housing having end shields that support a reel holder, a drum with a cutting device, the drum including, at one of its ends, a cam associated with a start and return spring and the other end of it being associated with an operating knob, is distinctive in that it consists of a single component which is designed and formed in the shape of an irregular crown in order to fulfil the various functions to control and limit the rotation of the drum when a strip of material is cut, said component being in the form of a flat part having an external profile which combines successive irregular, curved and straight shapes with protruding areas and in that said component is attached to one of the lateral end shields of the drum so that it floats loosely and is capable of moving differently as a function of either normal or fast rotation of the drum in order to provide limit stop and control effects.

BRIEF DESCRIPTION OF THE DRAWINGS

The object of the invention is described, merely by way of example, in the accompanying drawings in which.

In order that the present invention may more readily be understood, the following description is given, merely by way of example, reference being made to the accompanying drawings.

BRIEF DESCRIPTION OF THE DRAWINGS

The dispensing machine comprises the components described above.

Figure 1:
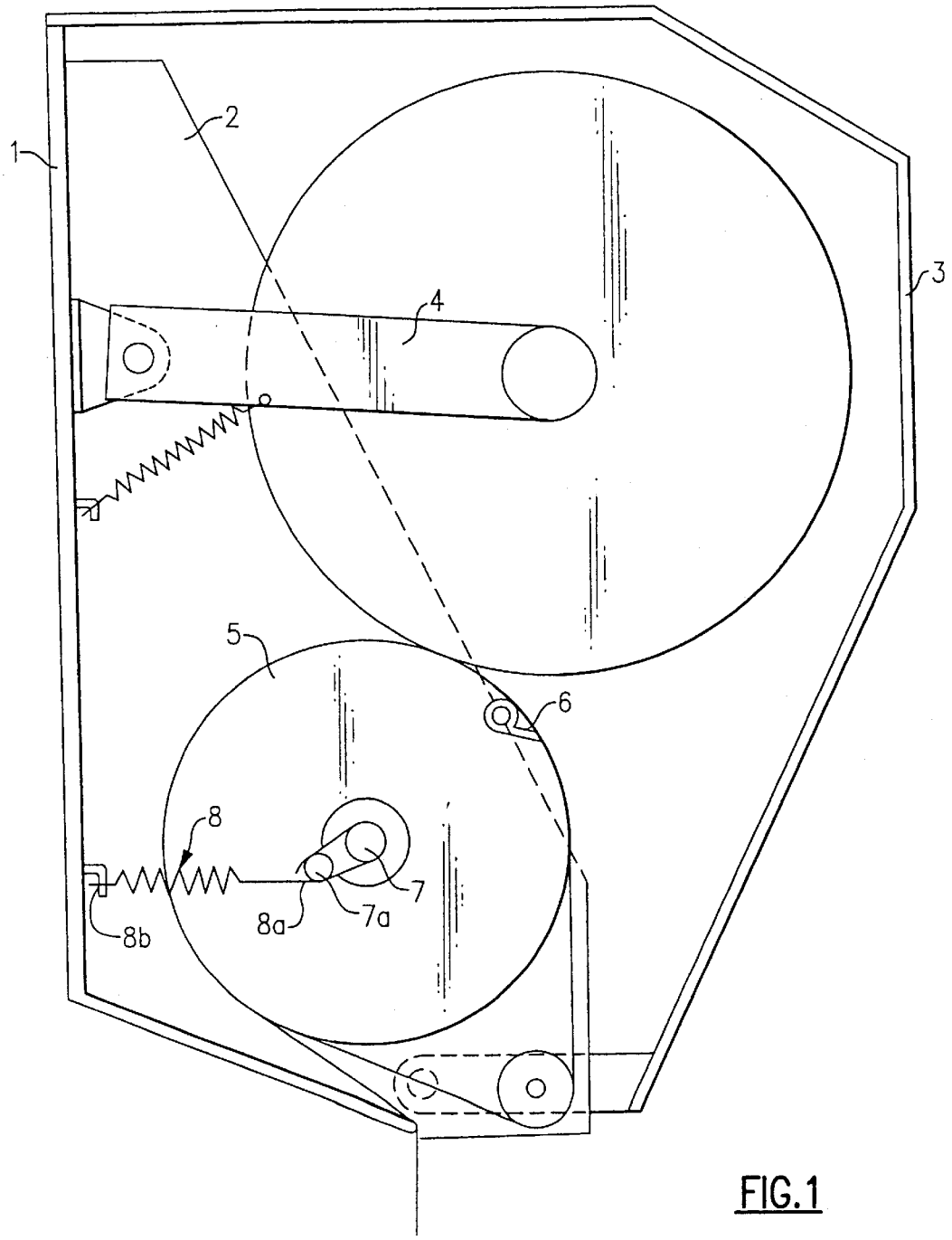
FIG. 1 is a view of the first side of the dispensing machine.

The device according to the invention is referred to in its entirety as (10). It consists of a single component which is designed and formed in the shape of an irregular crown in order to fulfil the various functions to control and limit the rotation of drum (5) when a strip of material is cut. This component is in the form of a flat part which may be made of a plastic, rigid elastomer or similar or polyurethane for example and it has a thickness of the order of 3 to 10 mm approx. This component has an external profile which combines successive irregular, curved and straight shapes with protruding areas, the functions of which will become apparent later on. This component has, in its centre, a substantially oval cut-out **(10*a*) which surrounds the rotation shaft (5*a*) of drum (5) and any shape made on one of the lateral end shields (5*b*) of the drum located opposite the elastic start and return means (7–8) of the drum as shown in FIG. 1. In other words, said component (10) which is the subject of the invention is located so that it can be positioned relative to the second lateral end shield of the drum opposite above-mentioned start and return mechanism (7–8)**.

The lateral end shield **(5*b*) of drum (5) has two protruding fingers (5*c* . 5*d*)** located non diametrically relative to the shaft of the drum with an offset represented by the line XOY.

These two protruding fingers are capable of allowing positioning or centring of the component which is designed with two shaped openings (10*b*–10*c*) through it, thus allowing the component to settle on above-mentioned protruding fingers.

These two holes have a substantially kidney-bean shape, each defining two consecutive areas (10*b*1–10*b*2; 10*c*1–10*c*2) with an intermediate constriction (10*d*) capable of allowing respective positioning of said protruding fingers formed on the end shield of the drum depending on rotation of the drum and of said component associated with it. Around the openings there is a shaped recess (10*e*) making it possible to position a connecting washer (11) which fits and attaches to said fingers whilst allowing loose, floating mounting of the component as will become evident in the rest of the description.

Figure 6:
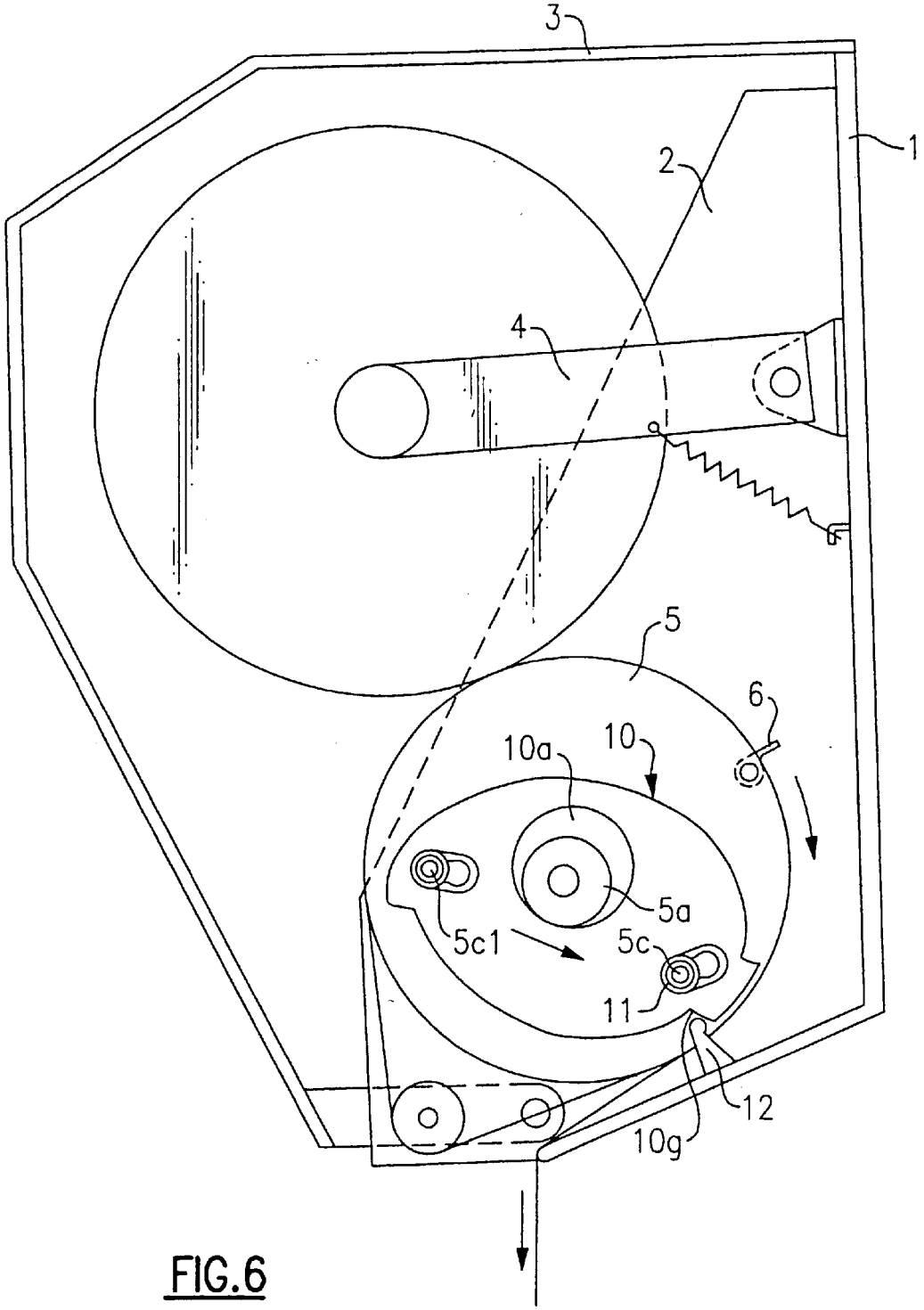
FIG. 6 is a side view according to FIGS. 2 and 3 showing, in particular, the position of the drum and the associated component in its limit-stop position if the strip of paper is pulled very hard.
Figure 7:
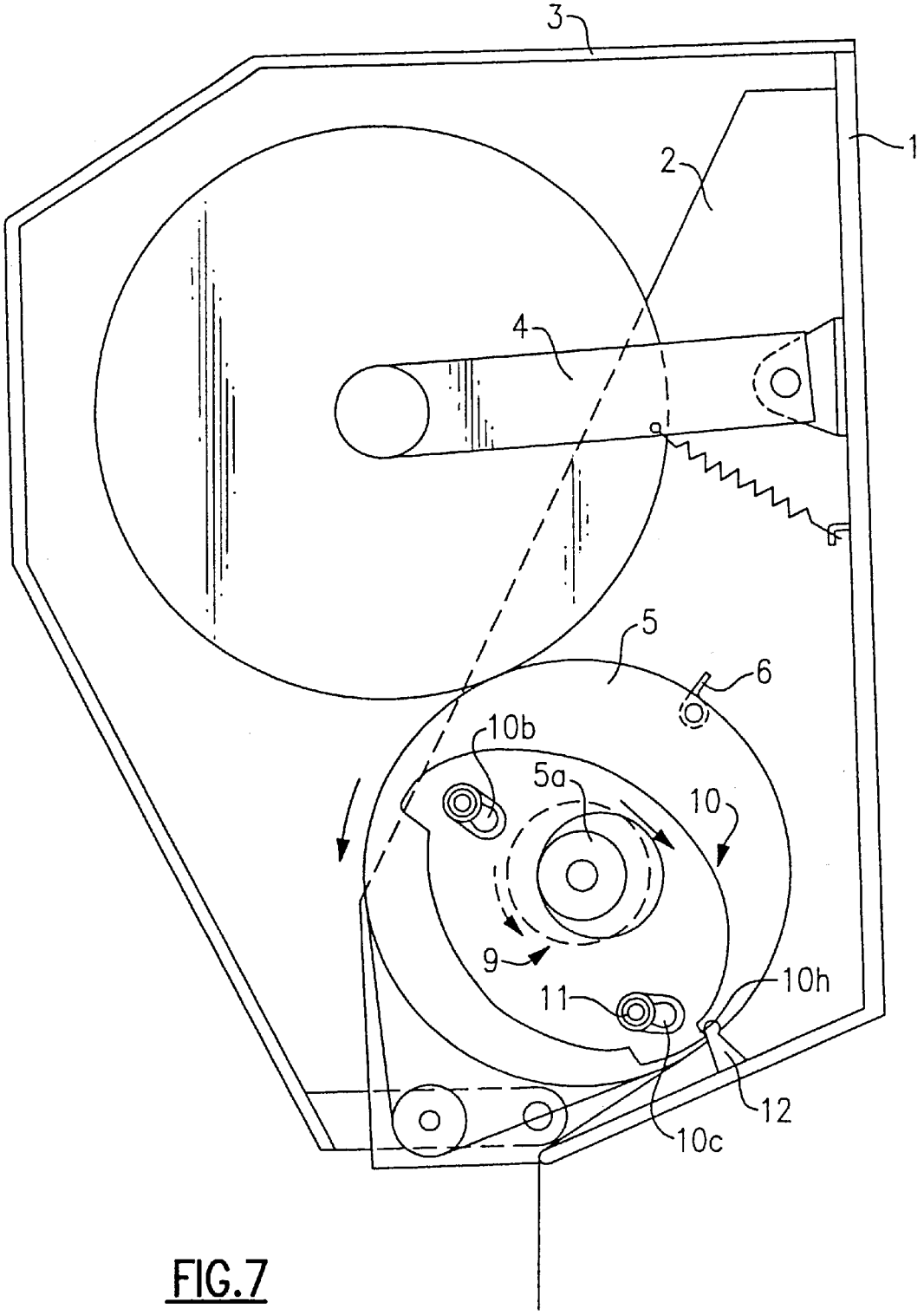
FIG. 7 is a side view according to FIGS. 2 and 3 showing the position of the drum and the component if the operating knob is turned in the opposite direction and its stopping in the non-return position.

The outer periphery of the crown-shaped component comprises four successive areas, namely:

- a first curved area (10-1) over an arc of approximately 180° starting close to one of the cut-outs (10*b*) and ending beyond the other cut-out (10*c*).
- a second area (10-2) consisting of the end of above-mentioned area and a straight surface (10*f*) facing towards the inside of the component in order to provide a limit stop for the ejected paper.
- a third area (10-3) starting beyond abovementioned area having a gradual curved shape over an arc of the order of 150° and ending near a fourth area (10-4) which has a protruding shape forming limit stops.
- this fourth protruding area (10-4) has straight surfaces (10*g*–10*h*) either side of it which merge into the first and third areas and form limit is stops, the respective functions of which are as follows: limit stop (10*g*) acts as a shock absorbing limit stop (see FIG. 6). This situation corresponds to pulling the strip of paper very hard. Limit stop (10*h*) is used to limit the unloading of the machine if the operating knob is turned in the opposite direction as shown in FIG. 7.

Note that the central opening (10*a*) in the component shaped like a crown is substantially off-centred relative to its midpoint in order to differentiate the volumes of the first and third areas by creating a kind of unbalance which allows, when the drum rotates, natural flipping of the component in order to achieve the desired functions.

Also, on the bottom of the housing, there is an integral or separately mounted small plate (12) which constitutes a fixed non-return limit stop, the role of which will become evident later on.

The operation of the device will now be explained, reference being made to FIGS. 2, 3, 4, 6 and 7 in particular.

Figure 2:
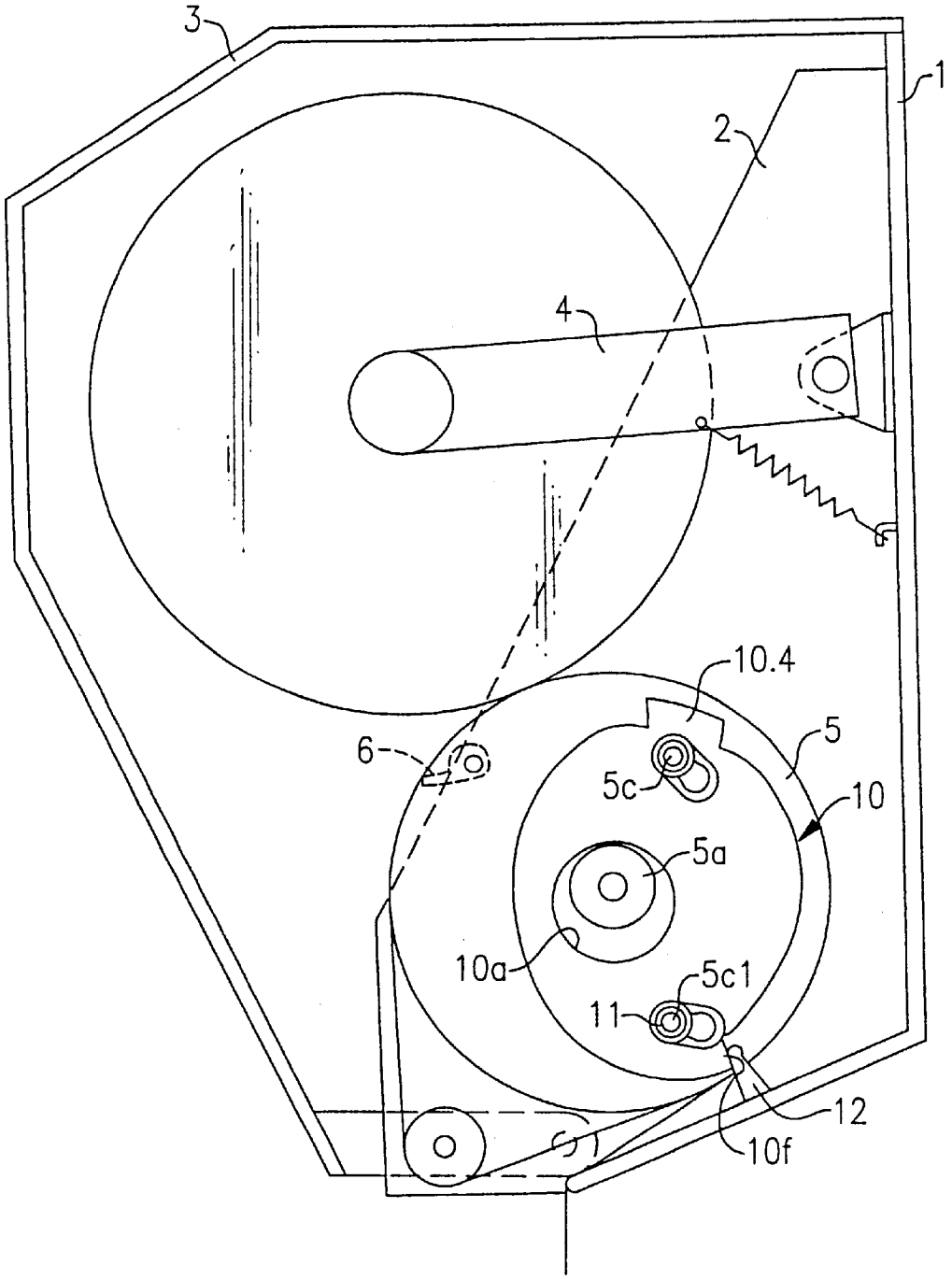
FIG. 2 is a view of the second side of the dispensing machine including the device according to the invention in its idle or non-return position which ensures the ejection of a normal-size piece of strip.

In FIG. 2 which corresponds to the idle position of the drum, the component which is loosely attached to the lateral end shield of the drum is in a low position relative to the shaft of the drum and the fingers. This position is substantially upright, considering the position of the second and fourth protruding areas around the periphery of the component. The latter is secured by the protruding fingers which locate in the openings made through it and, in particular, in areas (10*b*1) and (10*c*1), The second area forming a spur and limit stop (10*f*) is in contact with the fixed limit stop (12) on the housing so that it is impossible for the user to turn the drum backwards and a piece of paper of a predetermined size is ejected so that it can subsequently be grasped by the user.

Figure 3:
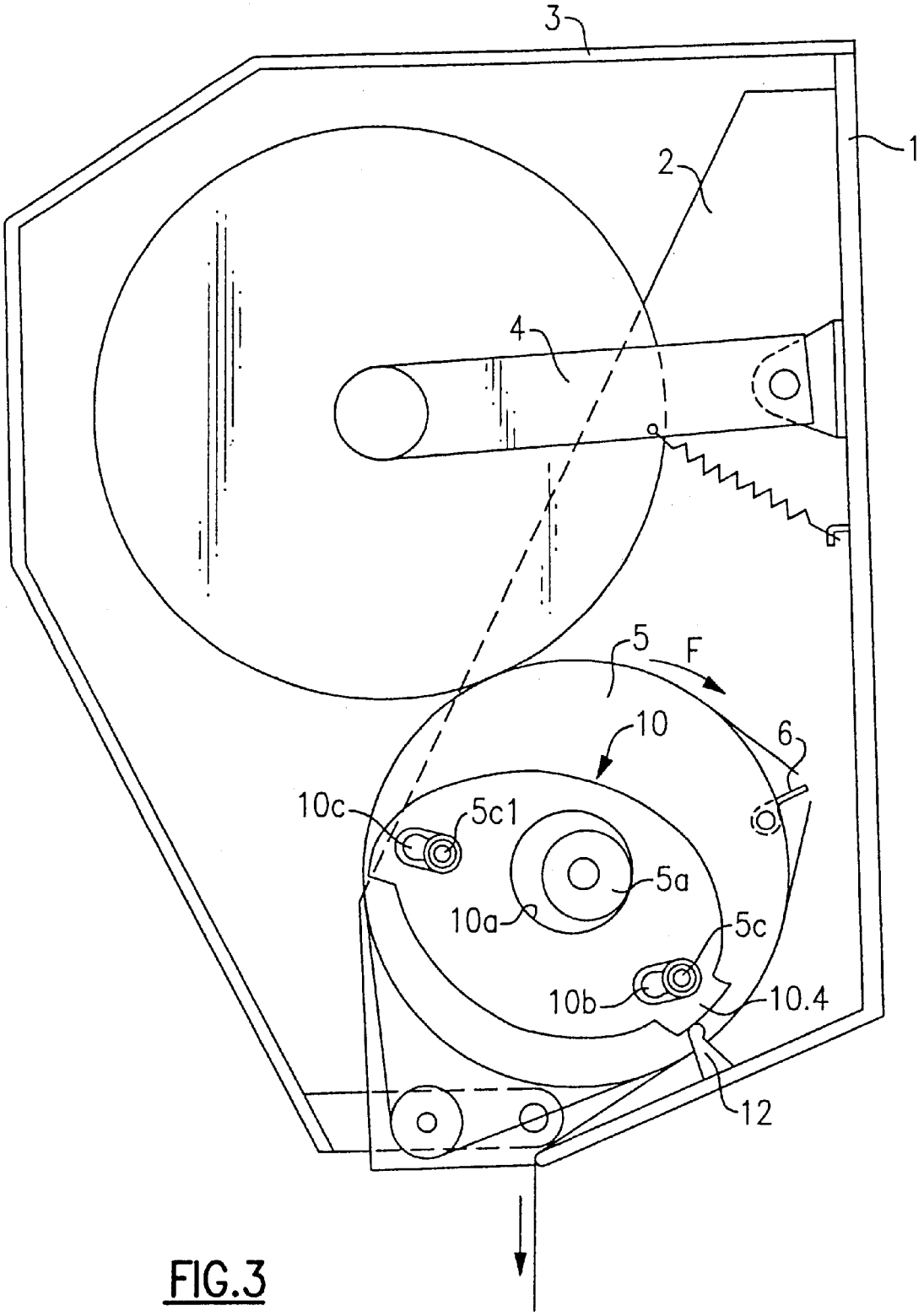
FIG. 3 is a view of the side in FIG. 2 in the cutting position of the drum and shows the arrangement of the device according to the invention.

Looking at FIG. 3, the drum has turned in the direction shown by arrow (F) due to the effect of the user pulling an emerging strip of paper. This rotation of the drum causes rotation of component (10) which is associated with it, but the latter remains in its initial position thanks to its openings (10*b*1) and (10*c*1) through which fingers (5*c*) and (5*d*) pass because it is retained by the constriction shapes (10*d*) of the corresponding openings. The fourth protruding area passes over the limit stop formed on the housing.

Figure 4:
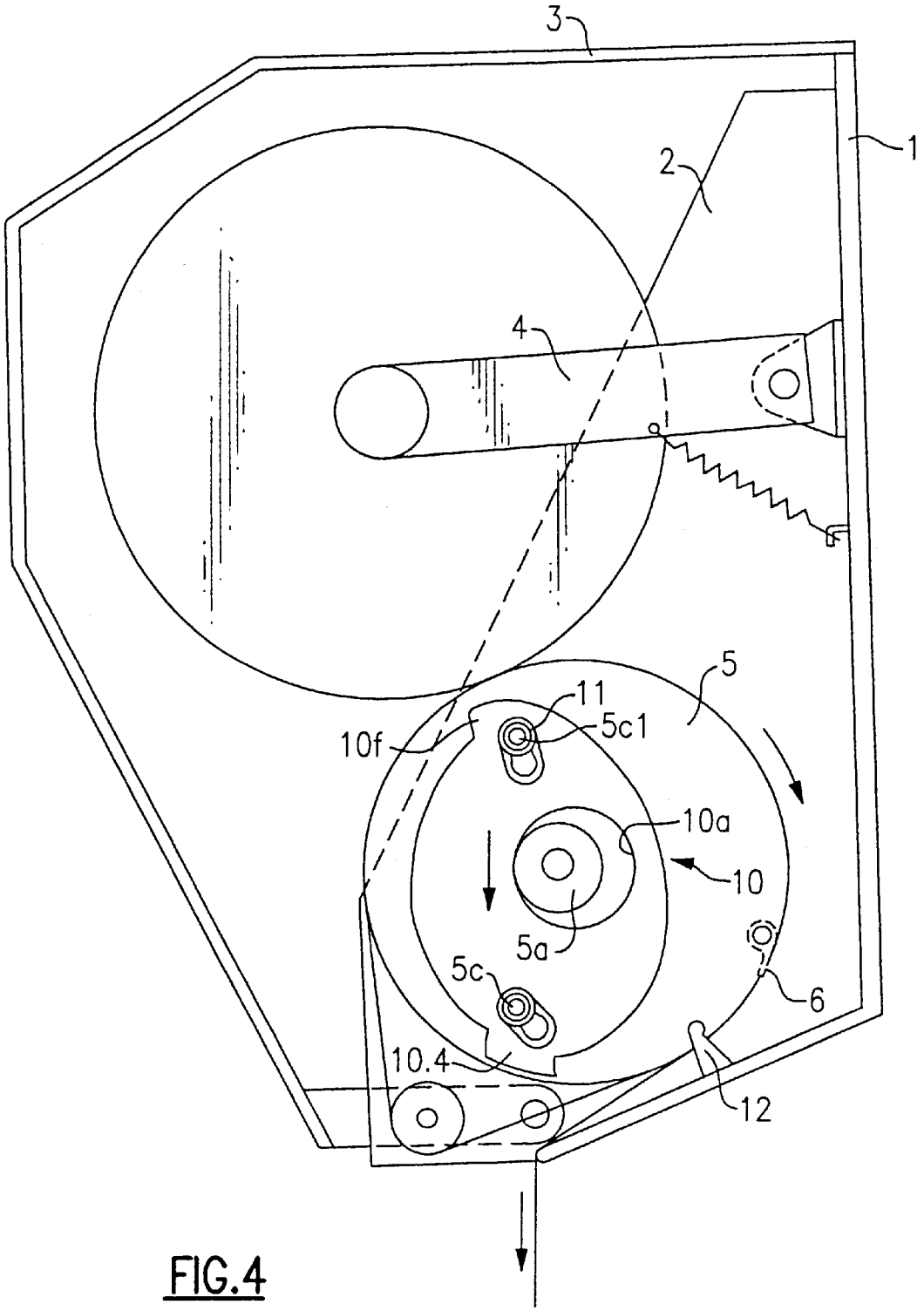
FIG. 4 is a side view according to FIGS. 2 and 3 and shows the drum in its end-of-cutting position and the arrangement of the device according to the invention.
Figure 5:
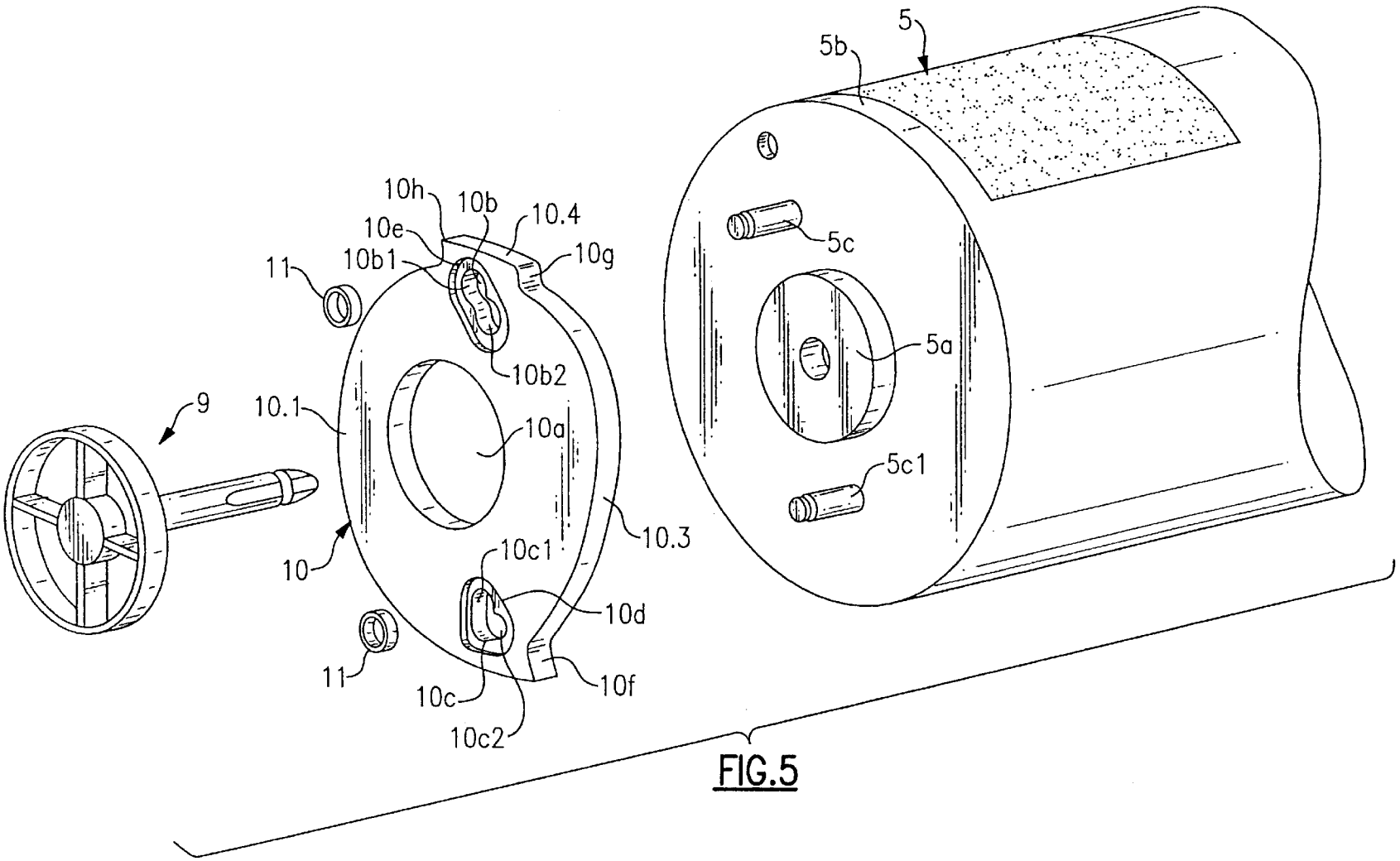
FIG. 5 is a partial perspective view before fitting the device according to the invention on the drum.

During the next phase shown in FIG. 4 at the end of cutting which corresponds to the blade being extended out of the drum, component (10) is in a position which is substantially upright and its cut-outs (10*b*) and (10*c*) face downwards, thus allowing said component to drop due to the effect of gravity and it moves from the first areas (10*b*1) and (10*c*1) to the second areas (10*b*2) and (10*c*2) in said cut-outs. It drops due to its unbalance.

During the next phase which allows the drum to return to its initial position due to the return force exerted by elastic means (7–8), the component is capable of flipping again and returning to the position shown in FIG. 2.

Looking at FIG. 6 which corresponds to the position of the drum and the component when the user pulls the strip of paper very hard, said component remains in its upper position on the finger due to very fast rotation of the drum. The protruding limit stop (10*g*) of the component comes up against fixed limit stop (12) on the housing. The drum then turns backwards under the effect of return spring (8) until limit stop (10*f*) in turn comes into contact, due to rotation of the drum, with fixed limit stop (12) formed on the housing. During backward rotation of the drum, the component flips on the protruding fingers, thus allowing limit stop (10*f*) to touch fixed limit stop (12).

Looking at FIG. 7 which shows the function of limit stop (10*h*), in this situation the operator has turned operating knob (9) the wrong way, thereby causing rotation of the drum in the wrong direction. Limit stop (10*h*) then strikes fixed limit stop (12), thereby preventing the machine from operating. It is therefore necessary to repeat the movement, but in the correct direction this time.

Figure 8:
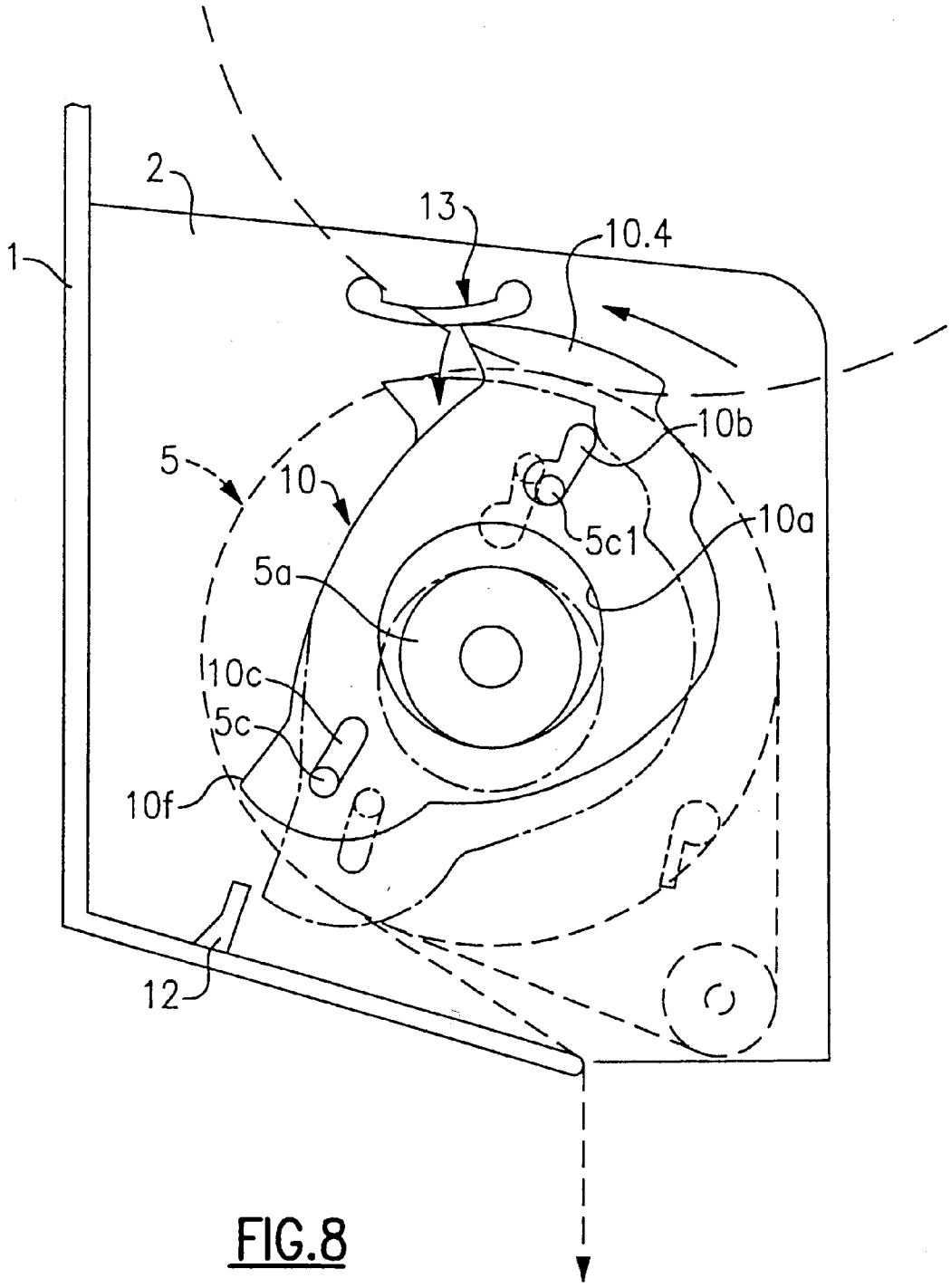
FIG. 8 is a side view according to FIGS. 2 and 3 showing a guide limit stop of the device according to the invention.

Looking at FIG. 8, the machine has an integrally moulded or separately mounted fixed, shaped, deflection limit stop (13) on the corresponding wall of the housing in its upper part. This fixed limit stop (13) deflects the protruding part (10.4) of the component if the strip of material is pulled hard in order to allow component (10) to be vertically lowered. The latter is released from its upper position and from the positioning shafts thanks to the through openings (10*b*1) (10*b*2) and moves towards the shaft of the drum. Because of this movement, part (10*f*) of the component comes into contact with non-return limit stop (12) formed in the lower part of the housing.

The advantages of the invention are clearly apparent. The simplicity of the device, which uses only a single component rather than the eight parts previously used to ensure the various functions stated above, is emphasised. The configuration of the component and the material of which it is made do not entail any special cost, especially in terms of moulding. Dependable operation is guaranteed. The machine operates more silently. The said component is also capable of absorbing noise and the material is capable of elastic deformation in the event of shocks and can absorb energy before returning to its initial configuration.

The example of a machine in which the reel of material is in contact with and rests against the drum has been described. The invention is also applicable if the reel of material is suspended from fixed end shields of the housing. In this case, the machine includes an additional pressure roller mounted between the end shields of the housing and pressing against the drum.

The fact that the defined shape of the component and the distribution of its material and its volume make it possible to obtain unbalance which has two functions also needs to be emphasised. When the drum rotates at its normal speed, the component drops under the effect of its own weight and only uses limit stop (10*f*) for the non-return and paper eject function.

During fast rotation of the drum, the unbalance due to the centrifugal force spreads and flips the component so that the surface of limit stop (10*g*) comes into contact with fixed limit stop (12) in order to stop it.

What is claimed is:

1. Device for controlling and limiting the rotation of the drum in a dispensing machine for material wipes of the type comprising a housing (1) and a cover (3), the housing having end shields (2) that support a reel holder (4), a drum (5) with a cutting device (6), the drum including, at one of its ends, a cam (7) associated with a start and return spring (8) and the other end of it being associated with an operating knob (9), a single component (10) which is designed and formed in the shape of an irregular crown in order to fulfill the various functions to controlling and limit he rotation of the drum (5) when a strip of material is cut, said component being in the form of a flat part having an external profile which combines successive irregular curved and straight parts with protruding areas, and in that said component is attached to one of the lateral end shields of the drum so that it floats loosely and is capable of moving differently as a function of normal or fast rotation of the drum in order to provide limit stop and control effects.

2. Device as claimed in claim 1, wherein the crown shaped component has, in its center, a substantially oval cut-out (10*a*) which surrounds the rotation shaft (5*a*) of drum (5) and is located opposite the elastic start and return mechanism (7–8) of the drum, and in that the lateral end shield (5*b*) of drum (5) has two protruding fingers (5*c*–5*d*) located non diametrically relative to the shaft of the drum and allowing positioning and centering of the component which has two shaped openings (10*b*–10*c*) through it, thus allowing the component to settle on above-mentioned protruding fingers.

3. Device as claimed in claim 1 including an integral or separate mounted small plate (12) on the bottom of the housing which constitutes a fixed non-return limit stop and is capable of co-operating with a protruding shape (10*f*) on the crown shaped component depending on the particular phase of operation.

4. Device as claimed in claim 2, wherein the two cut-outs in the crown shaped component each have a substantially kidney-bean shape defining two consecutive areas (10*b*1–10*b*2; 10*c*1–10*c*2) with an intermediate constriction (10*d*) capable of allowing respective positioning of said protruding fingers formed on the end shield of the drum depending on rotation of the drum and of said component associated with it.

5. Device as claimed in claim 2 which there is a shaped recess (10*e*) around the openings made in the crown-shaped component, making it possible to position a connecting washer (11) which fits on and attaches to said fingers while allowing loose, floating mounting of the component.

6. Device as claimed in claim 2, wherein the two protruding fingers (5*c*–5*d*) are arranged non-diametrically relative to the shaft of the drum with an offset.

7. Device as claimed in claim 1, the outer periphery of the crown-shaped component comprises four successive areas, including:

- a first curved area (10-1) over an arc of approximately 180° starting close to one of the cut-outs (10*b*) and ending beyond the other cut-out (10*c*);
- a second area (10-2) consisting of the end of above-mentioned area and a straight surface (10*f*) facing towards the inside of the component in order to provide a limit stop for positioning the ejected paper;
- a third area (10-3) starting beyond above-mentioned area having a gradual curved shape over an arc of the order of 150° and ending near a fourth area (10-4) which forms protruding limit stops; and
- a fourth protruding area (10-4) having straight surfaces (10*g*–10*h*) either side of it which merge into the first and third areas and form limit stops.

8. Device as claimed in claim 7 wherein the limit stop (10*g*) acts as a shock absorbing limit stop against fixed limit stop (12) on the housing if the strip of paper is pulled very hard.

9. Device as claimed in claim 7 wherein the limit stop (10*h*) is capable of cooperating with fixed limit stop (12) in order to block rotation of the drum and limit unloading of the machine if the operating knob is turned in the opposite direction.

10. Device as claimed in claim 1, wherein the central opening (10*a*) in the crown shaped component is substantially off centered relative to its midpoint in order to differentiate the volumes of the first and third areas by creating unbalance which allows, when the drum rotates, natural flipping of the component in order to achieve the desired functions.

11. Device as claimed in claim 1, including a fixed deflection limit stop (13) made on the corresponding wall of the housing in its upper part, said limit stop ensuring deflection of protruding part (10.4) of component (10) if the strip of paper is pulled hard, thereby causing said component to move toward the shaft of the drum.

* * * * *